US006692116B2

(12) United States Patent
Pan et al.

(10) Patent No.: US 6,692,116 B2
(45) Date of Patent: Feb. 17, 2004

(54) REPLACEABLE INK JET PRINT HEAD CARTRIDGE ASSEMBLY WITH REDUCED INTERNAL PRESSURE FOR SHIPPING

(75) Inventors: Yichuan Pan, San Diego, CA (US); David A. Neese, Escondido, CA (US)

(73) Assignee: Eastman Kodak Company, Rochester, NY (US)

( * ) Notice: Subject to any disclaimer, the term of this patent is extended or adjusted under 35 U.S.C. 154(b) by 26 days.

(21) Appl. No.: 10/163,540

(22) Filed: Jun. 6, 2002

(65) Prior Publication Data

US 2003/0227521 A1 Dec. 11, 2003

(51) Int. Cl.[7] ..... B41J 2/175; B41J 29/38
(52) U.S. Cl. ..... 347/85; 347/17
(58) Field of Search ..... 347/17, 84–87

(56) References Cited

U.S. PATENT DOCUMENTS

| | | | | |
|---|---|---|---|---|
| 4,458,469 A | * | 7/1984 | Dunn | 53/432 |
| 5,610,635 A | | 3/1997 | Murray et al. | 347/7 |
| 5,686,947 A | | 11/1997 | Murray et al. | 347/85 |
| 6,312,115 B1 | * | 11/2001 | Hara et al. | 347/86 |

* cited by examiner

*Primary Examiner*—Juanita Stephens
(74) *Attorney, Agent, or Firm*—Milton S. Sales

(57) ABSTRACT

Inkjet cartridge assemblies are provided for shipping with the internal pressure of their ink containers set during assembly at a reduced level at least 2 inches Hg gage below atmospheric pressure at sea level to avoid leaking during shipping. Preferably, the ink containers have an internal pressure set at least 9 inches Hg gage below atmospheric pressure at sea level.

8 Claims, 5 Drawing Sheets

REPLACEABLE INK JET PRINT HEAD CARTRIDGE ASSEMBLY WITH REDUCED INTERNAL PRESSURE FOR SHIPPING

CROSS REFERENCE TO RELATED APPLICATIONS

Reference is made to commonly assigned U.S. patent application Ser. No. 10/163,847 filed in the names of Yichuan Pan et al. on Jun. 6, 2002.

FIELD OF THE INVENTION

The present invention relates generally to inkjet printers, and more particularly to an ink jet print head cartridge assembly adapted for shipping and installation with reduced leakage.

BACKGROUND OF THE INVENTION

Ink jet type printers typically employ a pen body that is moved in a transverse fashion across a print media. Contemporary disposable ink pen bodies typically include a self-contained ink container, a print head supporting a plurality of ink jet nozzles in combination with the ink reservoir, and a plurality of external electrical contacts for connecting the ink jet nozzles to driver circuitry.

U.S. Pat. No. 5,686,947, which issued to Murray et al. on Nov. 11, 1997, discloses an ink jet printer which provides a continuous volume of ink to a pen body from a large, refillable ink reservoir permanently mounted within the ink jet printer. Flexible tubing, also permanently mounted within the inkjet printer, connects the reservoir to the pen body.

Even with the possibility of replenishment of the ink container within a disposable ink jet pen body, there eventually comes a time when the pen body must be replaced. Therefore, there is a substantial need to supply the market with replacement pen bodies. Leakage of ink from pen bodies during shipping and installation has been a problem in the industry. Consequently, replacement pen bodies have been shipped with "breathing" caps so that the pressure inside the pen bodies equal to atmospheric pressure during shipping to deal with the elevation and temperature changes. The breathing cap has a long needle to reach to the central region of a cartridge cavity, and the ink level in the cavity must be low enough to prevent the tip of the cap needle touching the ink at all possible orientations of the pen body. As consequence, a prior art pen body is shipped with less than desired amount of ink in it. Even pen bodies equipped with breathing caps have been found to leak ink from the cap due to vibration during shipping; and installation of pen bodies with breathing caps can be messy, as ink can leak from the ink inlet or from the nozzles during the installation process.

The most likely path of ink leakage during shipping is via the nozzles on the jet plate. Nozzle plates are commonly covered by tape that relies either on a thin layer of adhesive or on electrical static to stick to the nozzle plate. The adhesion or static force attaching tape over a nozzle plate is able to withstand only a predetermined pressure differential between the pressure inside the nozzles and the outside ambient pressure. If the internal pressure increases, the pressure differential across the tape increases. The pressure differential across tape can also be affected by the change of atmospheric pressure. When the pressure differential across tape increases to the point at which the tape is not able to stand the pressure differential, ink forces the tape to separate from the nozzle plate, and ink leakage occurs.

The internal pressure P can be affected by many factors during shipping and during storage in a warehouse at a customer site. For example, a cartridge housing can be distorted for different reasons to cause its volume, and the internal pressure, to change. However, the biggest factor affecting the internal pressure is temperature. Temperature can change dramatically during shipping and storage. High temperature can be experienced in non-air-conditioned trucks and warehouses on hot days. Cold temperature can occur in a cargo airplane or in a warehouse at a cold location in winter. When a pen body is factory filled with ink, an initial internal pressure is applied and ink container is sealed off. During shipping and storage, when temperature increases, the internal pressure increases.

The atmospheric pressure is primarily affected by altitude. A change of altitude can be experienced by a cartridge assembly in a cargo airplane or when the cartridge assembly is transported to a location having a different elevation. At sea level, atmospheric pressure is 29.92 inches Hg. When altitude reaches 10,000 ft above sea level, atmospheric pressure decreases to 20.58 inches Hg. A pressurized cargo airplane typically allows pressure in the cargo chamber to decrease to as much as 11 inch Hg gage below the atmospheric pressure at sea level. When atmospheric pressure decreases to less than the internal pressure in an ink chamber, there is a danger for ink leaking to occur.

SUMMARY OF THE INVENTION

According to a feature of the present invention, cartridge assemblies are provided for shipping with the internal pressure of their ink containers set during assembly at a reduced level at least 2 inches Hg gage below atmospheric pressure at sea level to avoid leaking during shipping. Preferably, the ink containers have an internal pressure set at least 9 inches Hg gage below atmospheric pressure at sea level.

BRIEF DESCRIPTION OF THE DRAWINGS

These and other objects and features of the invention will become more fully apparent from the following description and appended claims taken in conjunction with the following drawings, where like reference numbers indicate identical or functionally similar elements.

DETAILED DESCRIPTION OF THE INVENTION

Figure 1B:
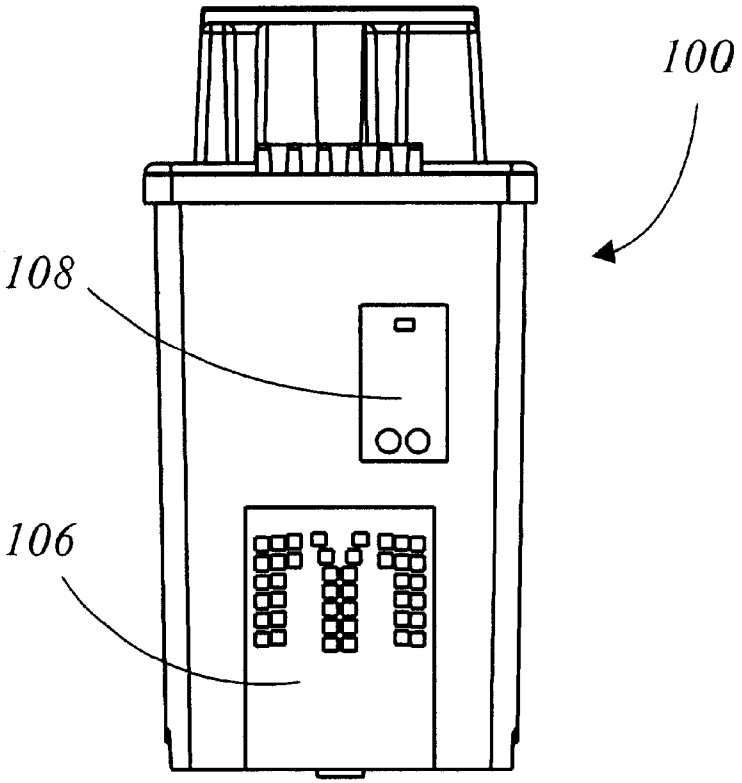
FIG. 1B is a rear view of the inkjet pen body of FIG. 1A.
Figure 1A:
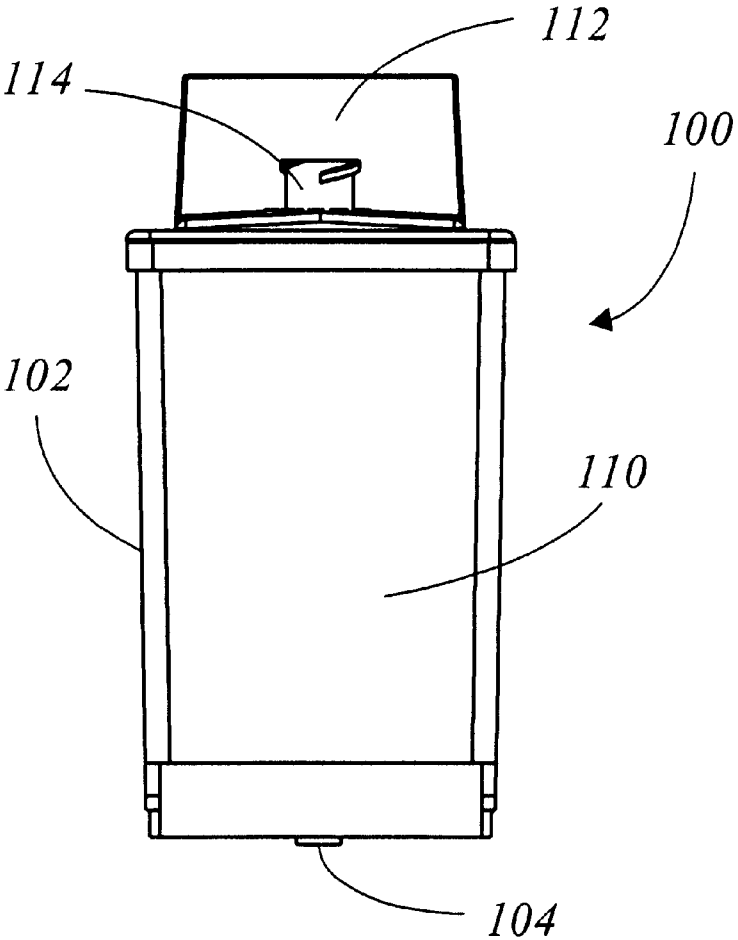
FIG. 1A is a front view of an ink jet pen body according to the present invention.

A preferred pen body for use with the present invention is similar to those pen bodies well known in the art such as the 208-jet™ cartridge, Part No. 12A1970, from Lexmark International Inc., of Lexington, Ky. However, modifications to this basic assembly have been made to provide an opening for supplying ink from an external reservoir. Referring to FIGS. 1A and 1B, a pen body 100 according to the present invention includes a housing 102 as in the Lexmark Part. No.

12A1970, a jet plate 104, an electrical connector assembly 106, a memory chip assembly 108, an ink container 110, and a top lid 112. The capacity of ink container 110 is preferably approximately 65 ml volume for commercially available inkjet printers, but other size pen bodies can be used with the present invention.

Jet plate 104 includes a plurality of inkjet nozzles that may be conventional in design. The jet plate is mounted to a bottom surface of pen body housing 102 such that ink ejected from the jet plate deposits onto paper or other print media which is positioned on a platen below pen body 100.

Electrical connector assembly 106 is positioned on pen body housing 102 to align with a mating electrical connector assembly (not shown) on a pen body holder as is conventional for inkjet printers. Connector assembly 106 transfers electrical control signals from the main control electronics in the printer housing to jet plate 104 for controlling the printing operation in a manner well known in the art.

Memory chip assembly 108 is attached to pen body housing 102 using a conventional method, such as adhesive, and is positioned to align with a mating electrical connector assembly (not shown) on a pen body holder, as is conventional for inkjet printers. Memory chip assembly 108 has a memory chip to hold data for the pen body and the ink jet printer system, such as ink type, ink color, and the amount of ink used for the pen body. The function of memory chip assembly 108 is disclosed in U.S. Pat. No. 5,610,635, which issued to Murray et al. on May 11, 1997.

Top lid 112, preferably plastic, is attached, such as by ultrasonic welding, to housing 102. The top lid has an integral opening and a female portion 114 of a quick disconnect fitting, preferably designed to standard female Luer Lock dimensions.

Figure 2:
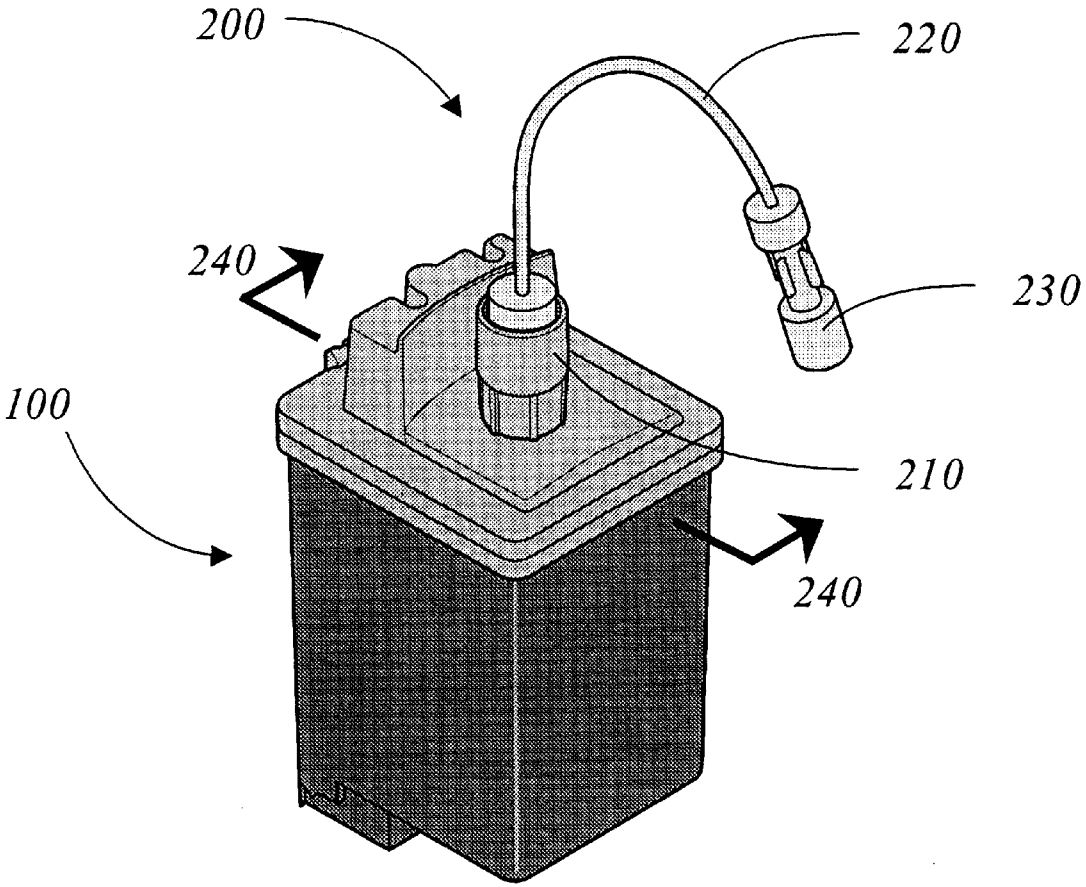
FIG. 2 is a perspective view of the ink jet pen body and an attached connection tube to form a cartridge assembly according to the present invention.

FIG. 2 is a perspective view of ink jet pen body 100 of FIGS. 1A and 1B and a connection tube 200 attached to pen body 100 to form a cartridge assembly. Connection tube 200 consists of a quick disconnect fitting 210, a flexible tubing 220 and a septum assembly 230. The connections from flexible tubing 220 both to quick disconnect fitting 210 and to septum assembly 230 are established by barb fittings. The flexible tubing is preferably made of polyurethane, but can be made of other proper materials. Quick disconnect fitting 210 mates with female portion 114 on top lid 112 of cartridge assembly 100. Preferably, male portion 210 of the quick disconnect fitting is a conventional Luer Lock fitting. Female portion 114, which is integral on the pen body and male portion of quick disconnect fitting 210 form a hermetic seal there between when they are connected. Additional details of connection tube 200 are disclosed in commonly assigned co-pending U.S. patent application Ser. No. 10/163,847 filed in the names of Yichuan Pan et al. on Jun. 6, 2002.

Figure 3:
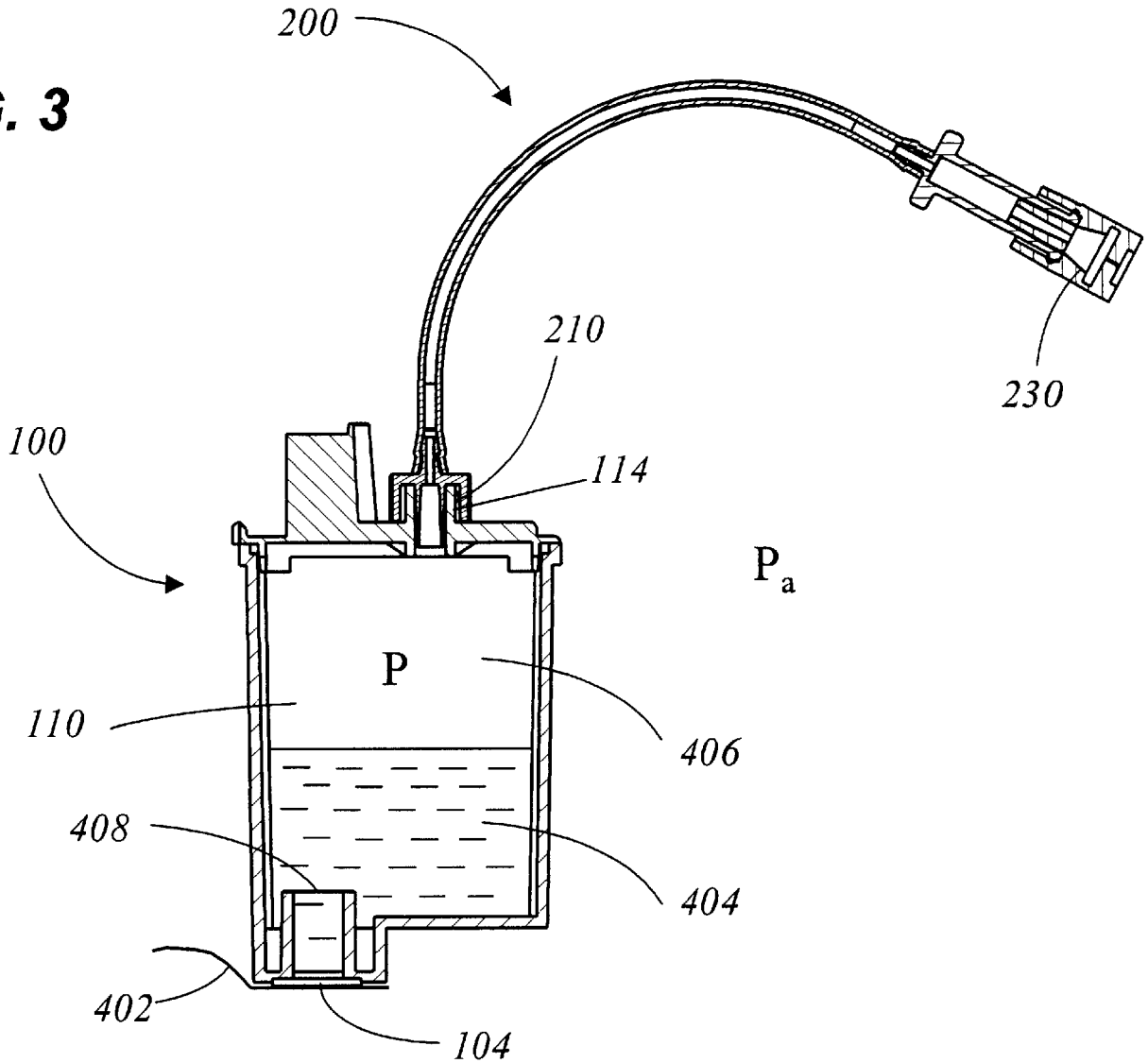
FIG. 3 is a cross-sectional view of the inkjet cartridge assembly taken along line 240—240 of FIG. 2.

FIG. 3 is a cross-sectional view of pen body 100 and connection tube 200 attached, taking along line 240—240 of FIG. 2. Ink container 110 of pen body 100 is filled with a proper amount of ink 404. An adequate volume of air 406 remains in ink container 110 after the factory ink filling process. The volume of air serves as a pressure buffer to absorb pressure surges during printing. Adequate air volume for the purpose of pressure buffering can vary greatly as a percentage of the volume of ink container 110, and is determined by the requirement to the volume of ink 404. The volume of ink 404 needs to be enough to cover a filter 408. During printing, pen body 100 moves back and forth, causing ink 404 to slosh in ink container 110. Therefore, increasing the volume of ink 404 helps to cover filter 408 during printing. When ink container 110 has a volume of approximately 65 ml, it is preferred that the volume of ink 404 be more than 25 ml. Pen body 100 is hermetically sealed by male-to-female quick disconnect fittings 114 and 210 on top and by nozzle plate tape 402 at the bottom. Nozzle plate tape 402 is a commercially available tape relying either on a thin layer of tape adhesive or on electrical static to stick to the nozzle plate. If a layer of adhesive is provided, the adhesive layer on the tape needs to be very thin so as to not form a blockage after tape 402 is removed when pen body 100 is installed into a printer.

The most likely path of ink leakage during shipping is via the nozzles on the jet plate 104. The adhesion or static force attaching tape 402 over the nozzle plate is able to withstand only a predetermined pressure differential between the pressure inside the nozzles and the outside ambient pressure. If the internal pressure P increases, the hydraulic pressure inside the nozzles increases as well, so that the pressure differential across nozzle tape 402 changes. The pressure differential across nozzle tape 402 can also be affected by the change of atmospheric pressure $P_a$. When the pressure differential across nozzle tape 402 increases to the point at which the nozzle tape 402 is not able to stand the pressure differential, ink forces nozzle tape 402 to separate from the nozzle plate and ink leakage occurs.

Figure 4:
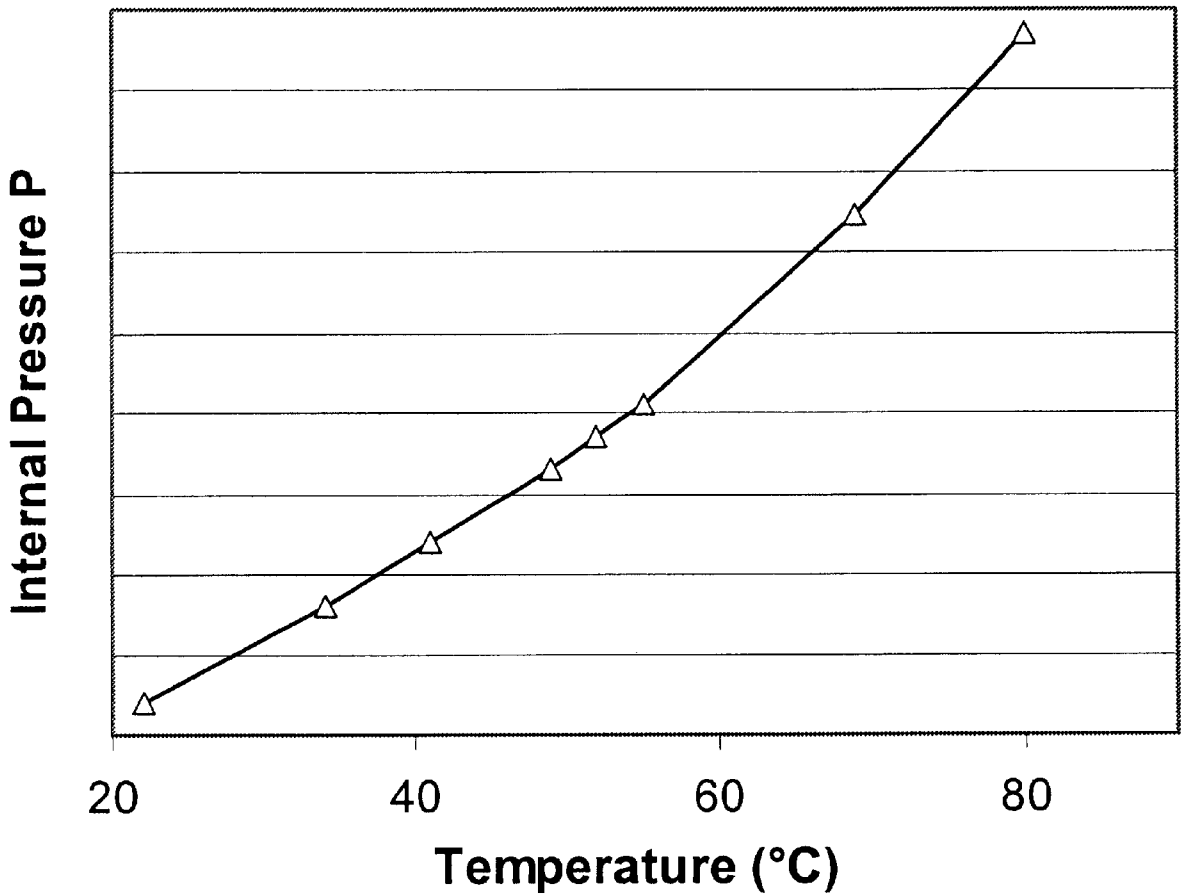
FIG. 4 is a graphical representation of the variation of pressure within a cartridge assembly with temperature.

The internal pressure P can be affected by many factors during shipping and during storage in a warehouse at a customer site. For example, cartridge housing 102 can be distorted for different reasons to cause the volume of ink container 110 and the internal pressure P to change. However, the biggest factor affecting internal pressure P is temperature. Temperature can change dramatically during shipping and storage. High temperature can be experienced in an un-air-conditioned trucks and warehouses on hot days. Cold temperature can occur in a cargo airplane or in a warehouse at a cold location in winter. The shipping and storage temperature can range from −40° C. to 60° C. When pen body 100 is factory filled with ink 404, an initial internal pressure $P_0$ is applied and ink container 110 is sealed off by connection tube 200 on top and by nozzle tape 402 at the bottom. The factory operation temperature is preferably controlled at around 25° C. During shipping and storage, when temperature decreases, the internal pressure P decreases. The decreased internal pressure P actually helps to prevent leaking. The relationship of pressure and temperature in a temperature range from about 20° C. to about 80° C. is illustrated in FIG. 4, in which the relationship is slightly non-linear. At higher temperature, the internal pressure increases faster with temperature than that at lower temperature. The non-linear effect is caused by the evaporation of water and other components of ink.

The atmospheric pressure $P_a$ is primarily affected by altitude. This change of altitude can be experienced by a cartridge assembly in a cargo airplane or when the cartridge assembly is transported to a location having a different elevation. At sea level, atmospheric pressure $P_a$ is 29.92 inches Hg. When altitude reaches 10,000 ft above sea level, atmospheric pressure $P_a$ decreases to 20.58 inches Hg. A pressurized cargo airplane typically allows pressure in the cargo chamber to decrease to as much as 11 inches Hg below the atmospheric pressure at sea level. When atmospheric pressure decreases to less than the internal pressure P in ink chamber 110, there is a danger for ink leaking to occur. The relationship between atmospheric pressure and altitude is available in various references.

In accordance with the present invention, the initial internal pressure $P_0$ in ink container 110 is set low enough to withstand the potential internal pressure increase and the atmospheric pressure decrease during the shipping and storage of the cartridge assembly. Initial internal pressure $P_0$ is at least 2 inches Hg gage below atmospheric pressure at sea level. The preferred initial internal pressure $P_0$ is about 9 inches Hg gage below atmospheric pressure at sea level. An even lower initial internal pressure $P_0$ can be set according to geographical distribution of customers and the method of transportation. Together with the adhering force of nozzle plate tape 402, provided by tape adhesive or electrical static, the initial internal pressure of 9 inches gage Hg at sea level is enough for the cartridge assembly to withstand shipping in a cargo plane, to survive at a customer site at 10,000 ft elevation, and withstand temperature rise to 60C below 3,000 ft elevation without leaking.

Figure 5:
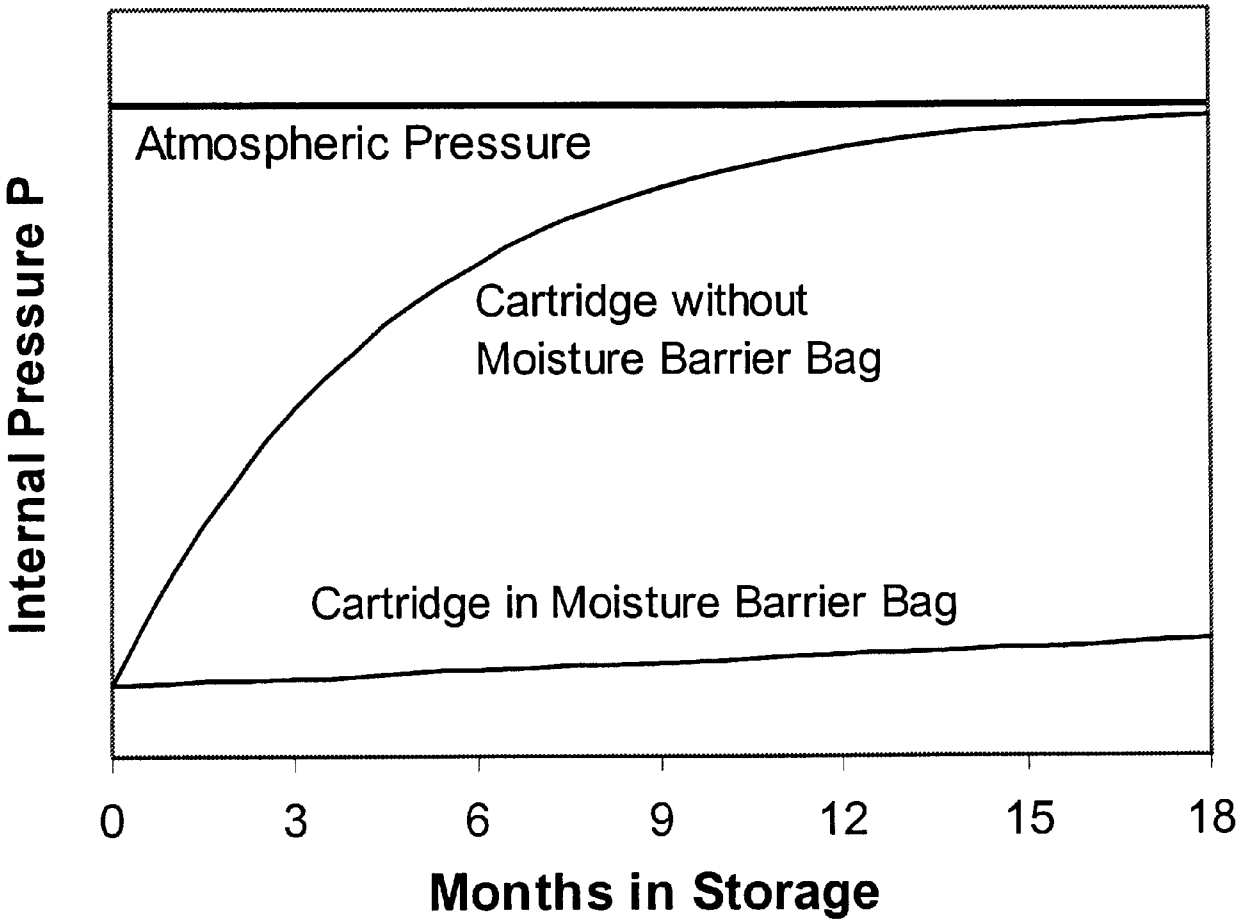
FIG. 5 is a graphical representation of the change in internal pressure in the cartridge assembly over time.

During long term storage, gradual permeation of air or gas through the components of the cartridge assembly plays an important role in maintaining leakage to a minimum. Gas permeation causes the internal pressure P to tend toward equalization with the atmospheric pressure $P_a$. The decay of the pressure difference over a period of 18 months is illustrated in the chart of FIG. 5. Many ways are available in the art the prevent the long term gas permeation. One example is to use non-permeable materials for the components of the cartridge assembly. An effective way to inhibit the decay of the pressure difference is to package cartridge assembly 100 and connection tube 200 in a vacuum sealed moisture barrier bag (not shown). Commercially available moisture barrier bags have specified properties of moisture vapor transfer rate (MVTR) according to standard test methods, such as ASTM F1249-90. Any commercially available moisture barrier bag having MVTR below 0.02 gm/100 $in^2$ per 24 hours at 100° F. reduces gas permeability dramatically and satisfies the needs of keeping the internal pressure P substantially constant during shipping and storage life. FIG. 5 also shows the relative flat curve of internal pressure P in a cartridge assembly packaged in a moisture barrier bag. It is preferred to use a soft and compliable bag. During the vacuum sealing process, air inside the bag and outside cartridge assembly 100 and connection tube 200 is drawn out so that the bag deforms to comply the outer surfaces of the cartridge assembly. More compliable bags tend to store less energy related to stiffness of the bag, and result in less stored vacuum between the bag and cartridge assembly. The bag pressure is preferred to be slightly lower than the initial internal pressure $P_0$. For $P_0$ of 20.57 inch Hg, for example, a bag pressure of 18.57 inches Hg can be applied. A commercially available vacuum sealer, either the chamber type or the retractable nozzle type, can be used for the vacuum sealing process. The retractable nozzle type, such as AVN-20 from AmeriVacS in San Diego, is preferred due to the less stress applied during vacuum sealing process.

What is claimed is:

1. An inkjet cartridge assembly comprising:

a pen body housing; and at least one hermetically sealed ink container in the housing, said container having an internal pressure set at least 2 inches Hg gage below atmospheric pressure at sea level.

2. An ink jet cartridge assembly as set forth in claim 1, further comprising:

a jet plate coupled to said pen body for ejecting droplets of ink; and nozzle plate tape hermetically sealed over the jet plate.

3. An ink jet cartridge assembly as set forth in claim 1, further comprising:

an ink inlet port through a wall of the housing; and a connection tube attached to the ink inlet port, said connection tube having a hermetically sealed septum remote from the inlet port, whereby the septum is adapted for connection to an ink supply.

4. An inkjet cartridge assembly as set forth in claim 1, wherein said internal pressure is set at least 9 inches Hg gage below atmospheric pressure at sea level.

5. A process for forming an ink jet cartridge assembly comprising:

providing a pen body housing having at least one hermetically sealed ink container; and creating an internal pressure in the ink container at least 2 inches Hg gage below atmospheric pressure at sea level.

6. A process as set forth in claim 5, further comprising:

providing the pen body housing with a jet plate coupled thereto for ejecting droplets of ink; and hermetically sealing the jet plate with nozzle plate tape.

7. A process as set forth in claim 5 wherein further comprising:

providing an ink inlet port through one wall of the pen body housing;

attaching a connection tube to the ink inlet port; and hermetically sealing the connection tube by a septum remote from the inlet port.

8. A process as set forth in claim 5, wherein said creating step creates the internal pressure in the ink container at least 9 inches Hg gage below atmospheric pressure at sea level.

* * * * *